United States Patent [19]

Ihira

[11] 4,307,814

[45] Dec. 29, 1981

[54] UNIT PANEL FOR USE IN STORAGE TANK CONSTRUCTION

[75] Inventor: Hiroshi Ihira, Takatsuki, Japan

[73] Assignee: Sekisui Koji Kabushiki Kaisha, Osaka, Japan

[21] Appl. No.: 858,085

[22] Filed: Dec. 6, 1977

[30] Foreign Application Priority Data

Jun. 1, 1977 [JP] Japan ..... 52-71810[U]
Jun. 2, 1977 [JP] Japan ..... 52-72091[U]
Jun. 8, 1977 [JP] Japan ..... 52-75012[U]

[51] Int. Cl.[3] ..... B65D 21/02
[52] U.S. Cl. ..... 220/5 A; 52/608
[58] Field of Search ..... 220/5 A, 1 B, 4 C, 83, 220/4 R; D25/92, 93; D34/15 FF, 15 GG; 46/30, 31; 52/608, 609

[56] References Cited

U.S. PATENT DOCUMENTS

| | | | |
|---|---|---|---|
| D. 243,453 | 2/1977 | Friedland . | |
| 1,864,153 | 6/1932 | Solon | D25/93 X |
| 2,222,908 | 11/1940 | King | 52/608 X |
| 2,395,685 | 2/1946 | Schmitz, Jr. | 220/5 A |
| 3,000,134 | 9/1961 | Marini | D34/15 GG |
| 3,034,254 | 5/1962 | Christiansen | 46/19 X |
| 3,064,770 | 11/1962 | Andrews | 220/5 A X |
| 3,426,937 | 2/1969 | Boschi et al. | 220/5 A X |
| 3,460,704 | 8/1969 | Moore et al. | 220/5 A |
| 3,568,387 | 3/1971 | Grabow | D25/93 X |
| 3,783,570 | 1/1974 | Storch | D25/92 X |
| 4,050,605 | 9/1977 | Wakana et al. | 220/5 A |

OTHER PUBLICATIONS

Smith System, *Lectern Desks and Speaker Stands,* pp. A–D, received in the Patent and Trademark Office 7/6/71.

*Primary Examiner*—Steven M. Pollard
*Attorney, Agent, or Firm*—Armstrong, Nikaido, Marmelstein & Kubovcik

[57] ABSTRACT

Unit panels for constructing tanks and tanks so constructed. The panels include a rectangular plate and four connecting rims. The connecting rims are provided on the four sides of the rectangular plate and extend in the same direction with respect thereto. The forward ends, or edges, of the connecting rims define a flat plane which is perpendicular with respect to the connecting rims; the rectangular plate being inclined with respect to the flat plane and at least two of the connecting rims have rectangular shapes.

Various embodiments of the unit panels are provided and include panels wherein two opposing connecting rims are rectangular, the remaining opposing rims being trapezoidal; panels wherein two adjacent connecting rims are rectangular, the remaining adjacent rims being trapezoidal; and panels wherein the rectangular plate is recessed or projections extending in a direction opposite to that of the connecting rims are provided on the rectangular plate.

Storage tanks constructed from the unit panels have inclined bottom portions to facilitate draining and can be provided with inclined sidewalls.

6 Claims, 38 Drawing Figures

UNIT PANEL FOR USE IN STORAGE TANK CONSTRUCTION

BACKGROUND OF THE INVENTION

1. Field of the Invention

This invention relates to a unit panel for use in constructing a storage tank, and also to a storage tank thus constructed. More particularly, this invention relates to a unit panel for constructing a storage tank from which a liquid can be completely discharged without difficulty because the tank has an inclined bottom.

2. Description of the Prior Art

In general, containers such as tanks have a characteristic that the bigger the capacity of the container, the more difficult it is to build the container. Additionally, if big containers are initially prepared in a finished state, it may often be inconvenient to transport the completed containers to the location at which they are to be installed. Thus, it is convenient when constructing a tank having a large capacity to carry and assemble at the required location unit panels which have been prepared beforehand in a factory, instead of constructing the tank in its finished state from the beginning.

Thus, tanks have heretofore been constructed by connecting a number of unit panels beforehand prepared in a factory. To this end, a unit panel was used comprising a rectangular plane (a) with connecting rims (b) and (c) as shown in FIG. 1. The connecting rims consist of an inclined rim (b) and a perpendicular rim (c). The inclined rim (b) is provided at the periphery of plate (a) to extend at an angle of 135° with respect to the plane of the plate (a). The rim (c) is provided at the outer edge of the inclined rim (b) at an angle of 135° with respect to the plane of the inclined rim (b), and, accordingly, at an angle of 90° with respect to the plane of the plate (a). The unit panel of FIG. 1 has the structure that the rectangular plate (a) is parallel to an open plane including, or defined by, edges of the perpendicular rims, and each of the perpendicular rims is in the form of a rectangle.

The unit panel of FIG. 1, however, has the disadvantage that, when several of the panels are assembled to form the bottom of a tank, it is difficult to discharge liquid completely from the tank because the bottom is flat and the liquid is hard to collect around an outlet as the amount of liquid is decreased.

It is a primary object, therefore, of the present invention to provide a unit panel for use in forming a tank, especially a bottom of a tank, which bottom is partly inclined, and from which the liquid can be completely discharged without difficulty.

The unit panel in the present invention is similar to the known unit panel in that the perpendicular rims are provided to stand at an angle of 90° with respect to the open plane connecting edges of the perpendicular rims. However, the unit member of the present invention is difficult in that the plane of the plate, or top, is inclined with respect to said open plane.

SUMMARY OF THE INVENTION

According to the present invention a unit panel is provided having a structure such that a rectangular plate is folded at four sides in the same direction to form a shallow lid provided with four connecting rims around the sides, that all forward ends of the connecting rim lie in a hypothetical flat plane, or so-called open plane, that each edge line between the connecting rims stands perpendicularly in relation to said open plane; the panel being characterized in that at least two of said four connecting rims have rectangular shapes and that the top plate is inclined with respect to the open plane.

The unit panel according to the present invention includes many types of embodiments. Among them, is the case in which two connecting rims having a rectangular shape are located in an opposing relation. A second embodiment is the case in which two connecting rims having a rectangular shape are adjacent to each other. A third embodiment is the case in which at least one inclined rim is further provided between the plane and the rectangular rim in each of the first and second cases. A fourth embodiment is the case in which at least one projecting portion is provided on the plate in each of the first three embodiments. A fifth is the case in which a recessed portion is provided on the plate for gathering a liquid and providing an outlet for discharging the liquid.

The unit panels according to the present invention can also be used for constructing the sidewalls of a tank. The unit members bring about various advantages when used for such construction.

BRIEF DESCRIPTION OF THE DRAWINGS

The present invention can be explained by way of examples referring to the drawings, in which:

FIGS. 2 to 5 show unit panels belonging to the first embodiment mentioned above; FIGS. 6 to 9 show unit panels belonging to the second embodiment; FIGS. 10 to 20 show unit panels belonging to the third embodiment; FIGS. 21 to 24 show unit panels belonging to the fourth embodiment; and FIGS. 25 to 29 show unit panels belonging to the fifth embodiment.

Referring to the figures, the unit panels according to the invention are described in detail hereinbelow.

DESCRIPTION OF PREFERRED EMBODIMENTS

In said first embodiment, a unit panel is provided which is in the form of a shallow rectangular lid comprising a rectangular plane which forms the top of the lid and four connecting rims, or flanges, provided at each periphery of the plate. All forward ends of the rims lie in an imaginary flat plane, a so-called open plane, defined by the forward ends of the rims, and all said rims stand at an angle of 90° with respect to the flat plane. The rectangular plate is inclined with respect to the flat plane and two of said rims are rectangular, differing only in height, and are located opposite to each other. Thus, each of the four edge lines formed by the intersection of the rims stand at the angle of 90° with respect to said flat plane, two adjacent edge lines being higher, or longer, than the two remaining adjacent edge lines. Consequently, the two remaining opposing rims are in the shape of a trapezoid in which the upper side is inclined with respect to the lower side. It is to be noted that as employed herein the term "rectangular" is intended to include square shapes.

Figure 2:
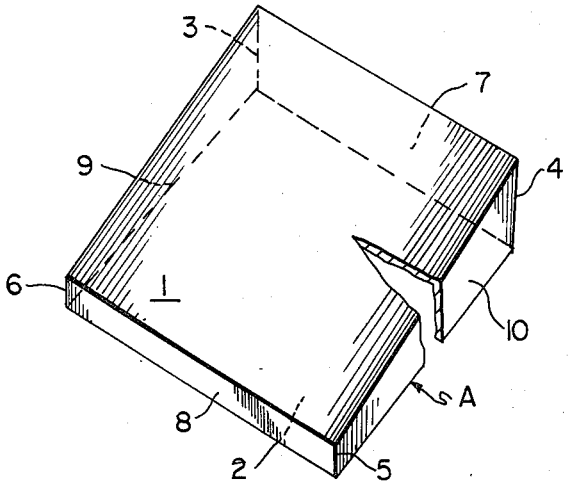
FIGS. 2 to 29 show various embodiments of unit panels according to the present invention; each of said figures being a perspective view of the unit panels, sometimes partially cut away. More particularly.

FIG. 2 shows a typical unit panel belonging to the first embodiment. In FIG. 2, unit panel A is in the form of a shallow rectangular lid consisting of a rectangular plate 1 and four connecting rims 7, 8, 9, 10, each of which is formed about a periphery, or side edge, of plate 1. It is to be noted that although the terminology "rim" is used herein to describe components such as 7, 8, 9 and 10 of the unit panels according to the present invention, such terminology can be used synonomously with "sidewall", "flange", etc. Forward ends, or edges, of connecting rims 7, 8, 9 and 10 lie on a flat plane 2 (hereinafter referred to as an open plane). All connecting rims 7, 8, 9 and 10 stand upright with respect to open plane 2, and consequently all four edge lines 3, 4, 5 and 6 formed by the intersection of rims 7, 8, 9 and 10 stand upright, i.e., perpendicular, with respect to open plane 2. The adjacent lines 3 and 4 of said four edge lines are equal in height and higher than the remaining adjacent edge lines 5 and 6, which are also equal in height.

Thus, two rectangular rims 7 and 8 and two trapezoidal rims 9 and 10 are formed between the four edge lines 3, 4, 5 and 6. Initially, plate 1 of the unit panel should have four "peripheries", or edges, which must lie on a flat plane (referred to as the plate periphery). However, portions of plate 1 excluding said four peripheries may be projected in any form, for example, in the form of a dome 12 as in FIG. 3.

The unit panel A may be made of a metal such as aluminum or steel, or a hard plastic such as thermosetting resin reinforced by fibers, for example, unsaturated polyester resin reinforced by glass fibers.

Figure 3:
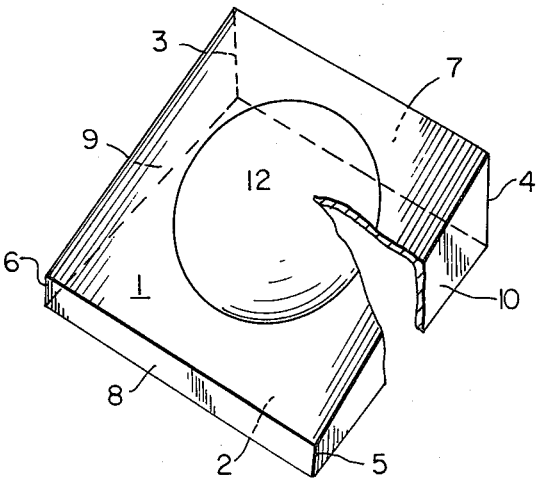

The present invention includes many types of unit panels, among which unit panel A is one of the most fundamental panels. Unit panel A may be modified in various ways. For example, as already stated, unit panel A may be modified by providing plate 1 with a projection in the form of a dome 12 as shown in FIG. 3. Additionally, plate 1 may have projections in the form of any desired pattern such as, for example, a cross star, or floral pattern.

Figure 4:
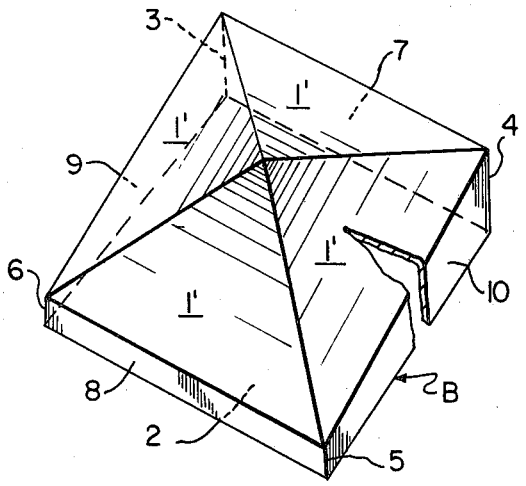
Figure 5:
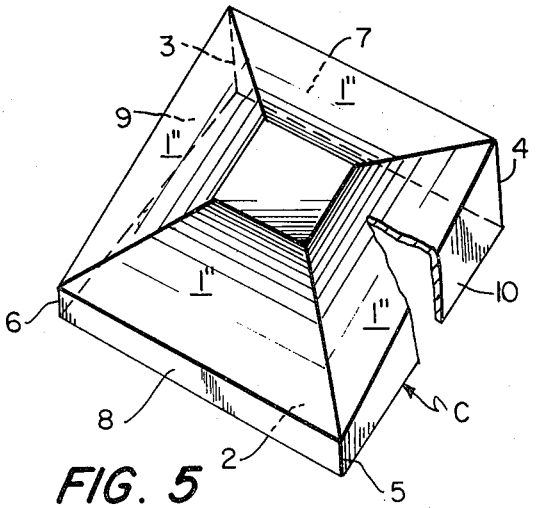

The first embodiment also includes unit panel B as shown in FIG. 4 and unit panel C as shown in FIG. 5. In unit panel B, plate 1' is projected in the central portion progressively upward toward the center thereof to form a quadrangular pyramid. In unit panel C, plate 1" is likewise projected in the central portion to form a truncated quadrangular pyramid. Plates 1' and 1" may also be provided with various projections.

A unit panel within the scope of the second embodiment is in the form of a shallow rectangular lid comprising a rectangular plate and four connecting rims provided at each periphery of the plate. All forward edges of the rims lie in a flat, or open, plane. All the rims stand at the angle of 90° with respect to the open plane. The rectangular plate is slightly folded along a digital line to form a convex or concave surface comprising two intersecting flat plates. At least one of said two intersecting flat plates is inclined with respect to the open plane. Two adjacent connecting rims have a rectangular shape and the two remaining adjacent rims have a trapezoidal shape, the upper side of which is slightly inclined with respect to the lower side. Particularly, the unit panel includes four edge lines, which are formed between the connecting rims and three of which are of equal height; the remaining edge line having a slightly lower height.

Figure 6:
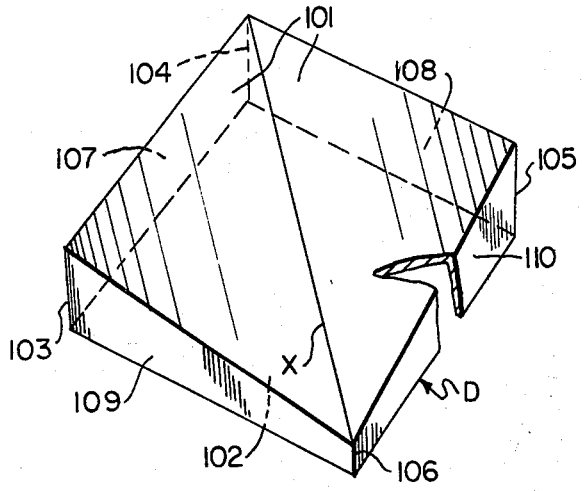

FIG. 6 shows unit panel D, which belongs to the above second embodiment. Unit panel D is in the form of a shallow lid consisting of a rectangular plate 101 and four connecting rims 107, 108, 109 and 110. Rectangular plate 101 is slightly folded along a diagonal line X to form two flat plates intersecting each other along line X. Plate 101 has a slightly concave surface. Each of the connecting rims 107, 108, 109 and 110 stands at an angle of 90° with respect to the open plane 102. Connecting rims 107 and 108 have rectangular shapes and are located adjacent to each other to form an edge line 104. Connecting rims 109 and 110 are also located adjacent to each other to form an edge line 106 and each have a trapezoidal shape, in which the upper side, i.e., the side adjacent the rectangular plate 101, is slightly inclined with respect to the lower side. Four edge lines 103, 104, 105 annd 106 stand upright with respect to open plane 102. Three edge lines 103, 104 and 105 have the same length. The remaining edge line 106, however, is shorter. Thus, if liquid is placed on plate 101, the liquid flows down along the diagonal line X, and is gathered at edge 106.

Figure 7:
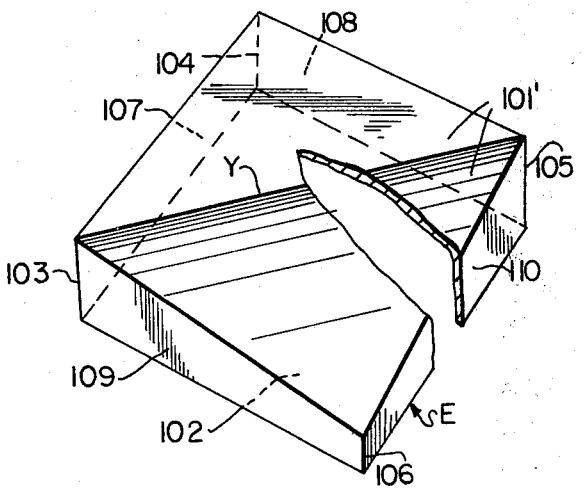

FIG. 7 shows a unit panel E, which is also a unit panel according to the second embodiment. Unit panel E is likewise in the form of a shallow lid consisting of rectangular plate 101' and four connecting rims 107, 108, 109 and 110. Further particulars of unit member E are the same as those for unit member D, the only exception being that the plate 101' of unit member E is folded along a diagonal line Y passing through edge lines 103 and 105. Since edge lines 103, 104 and 105 are of the same length, and edge line 106 is of a shorter length than the other three edge lines, plate 101' forms convex surface comprising two flat plates intersecting along a diagonal line Y. Half of plate 101' is level, i.e., parallel to the open plane 102, but the remaining half is inclined. Thus, if liquid is placed on plate 101', it flows in the direction of edge line 106.

Figure 8:
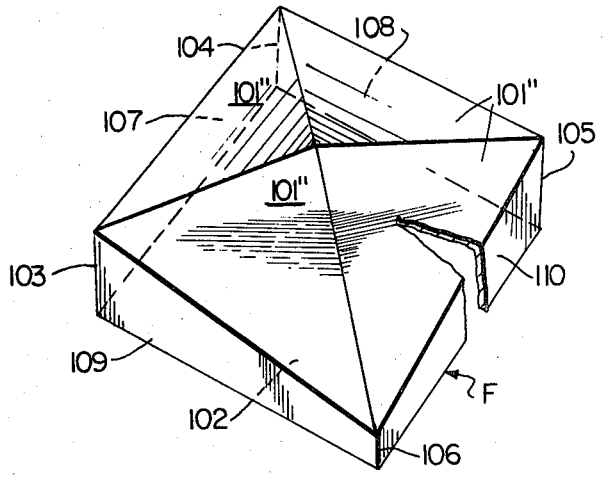

FIG. 8 shows a unit panel F also belonging to the second embodiment. Unit panel F is different from unit panels D and E in that plate 101" is raised at the center thereof to form a quadrangular pyramid. If liquid is placed on unit panel F, the liquid will be dispersed in all directions but will eventually flow towards edge line 106.

Figure 9:
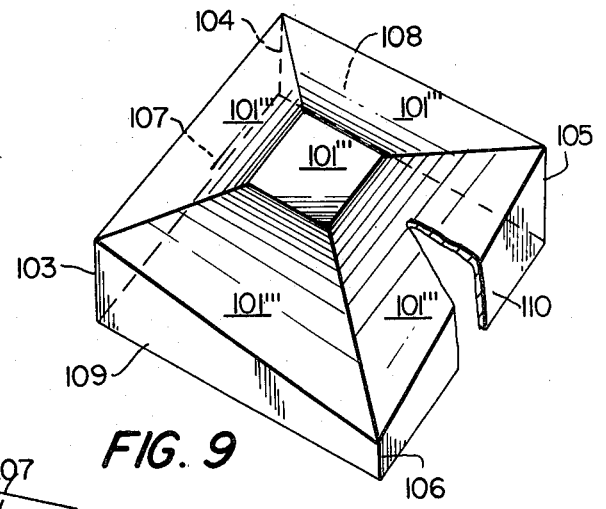

FIG. 9 shows another unit panel belonging to the second embodiment. This unit panel is almost the same as unit panel F, with the only exception being that plate 101''' forms a truncated quadrangular pyramid. Liquid placed on the unit panel flows in almost the same manner as in the case of unit panel F.

The third embodiment is a unit panel comprising at least one inclined rim between the rectangular plate and a perpendicular rim. The inclined rim is usually provided at a position wherein the perpendicular rim is rectangular in shape. If an inclined rim is to be provided on a unit panel according to the first embodiment, the inclined rim should be provided adjacent the taller rectangular perpendicular rim. The inclined rim herein referred to is an intermediate rim located between the plate, or top, of the panel and a perpendicular rim and provided so as to intersect with the perpendicular rim at the angle of 135°, and accordingly to make an angle of 45° with respect to the open plane.

Figure 10:
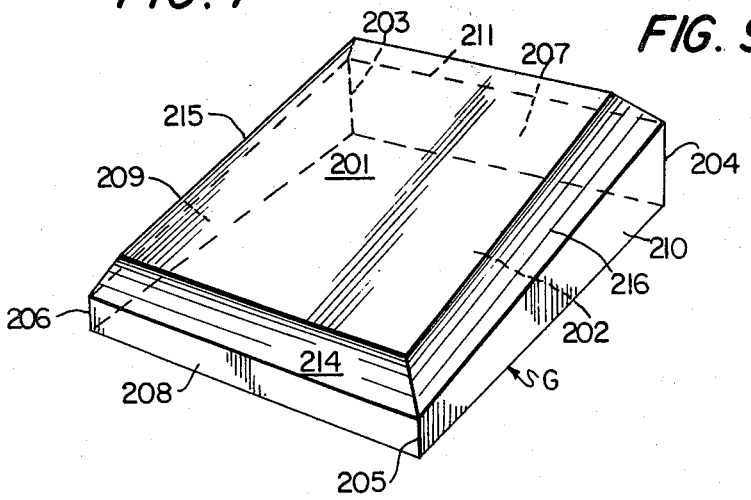

FIG. 10 shows a unit panel G, which corresponds to unit panel A provided with an inclined rim 211 and three "slant" surfaces 214, 215 and 216. Unit panel G has two perpendicular connecting rims of rectangular shape 207 and 208, and inclined rim 211 is provided only at the rim of the taller rectangular shape 207. Unit panel G has three slant surfaces 214, 215 and 216, which are distinguished from the inclined rim 211 in that the inclined rim 211 must be provided at an angle of 135° with respect to the adjacent perpendicular rim 207. The slant surfaes, however, may be provided at any desired angle with respect to the perpendicular rims adjacent thereto. Furthermore, the inclined rim 211 is distinguished from the slant surfaces 214, 215 and 216 in that the inclined rim 211 may be used for mounting a wall unit panel. The slant surfaces can not be used for mounting it. Perpendicular rims 207 and 208 are rectangular in shape. Perpendicular rims 209 and 210 are trapezoidal in shape in which the upper side is inclined with respect to the lower side. Inclined rim 211 is of a trapezoidal shape, and slant surfaces 214, 215 and 216 are also of a trapezoidal shape.

Figure 11:
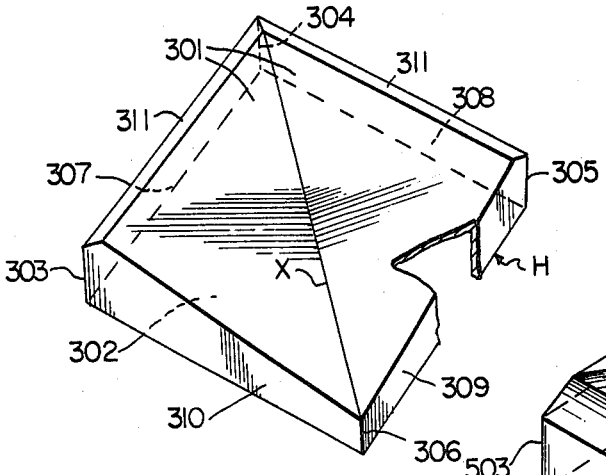

FIG. 11 shows a unit panel H according to the third embodiment. Unit panel H corresponds to unit panel D provided with two inclinded rims 311. Inclined rims 311 are provided between plate 301 and perpendicular rims 307 and 308. The inclined rims 311 are provided adjacent to each other and at an angle of 135° with respect to the perpendicular rims 307 and 308, respectively. The inclined rims 311 each have a trapezoidal shape.

Figure 12:
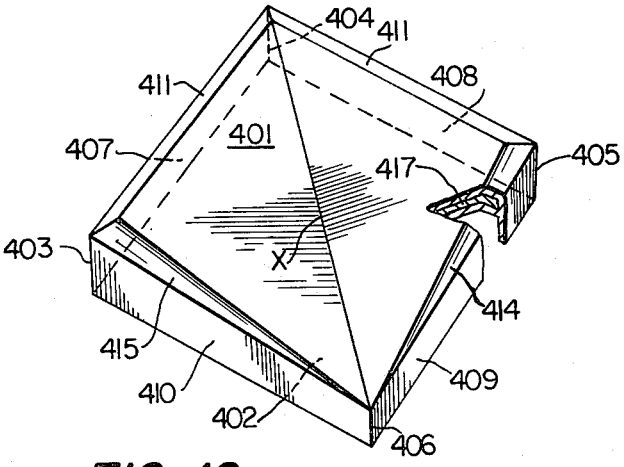

FIG. 12 shows another unit panel according to the third embodiment. The unit panel corresponds to unit panel H with the exceptions that plate 401 has a sandwich struture and two slant faces 414, 415 are provided between the plate 401 and perpendicular rims 409 and 410, respectively. Perpendicular rims 409 and 410 have a rectangular shape and, as a consequence, slant faces 414 and 415 are triangular. The sandwich structure of plate 401 is not limited to this unit panel, but may be included in any of the unit panels according to the present invention. The sandwich structure is valuable in improving thermal insulation of the unit panel. The slant faces 414 and 415 may be provided at any desired angle with respect to the respective adjacent perpendicular rims.

Figure 13:
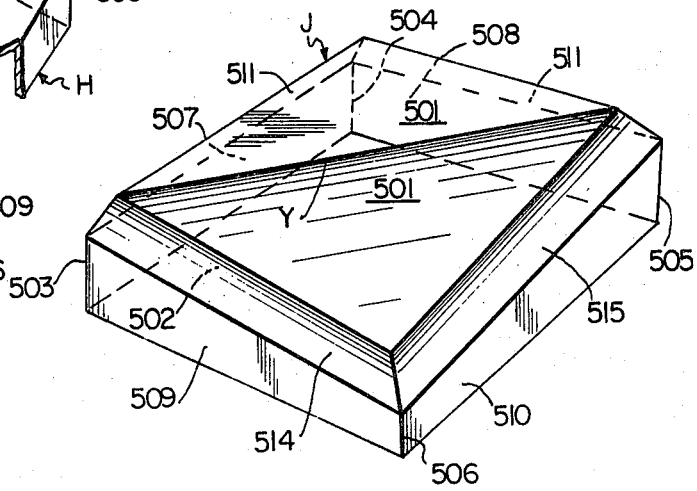

FIG. 13 shows even another unit panel J according to the third embodiment of the present invention. The unit panel J corresponds to unit panel E but which is further provided with two inclined rims 511 and two slant faces 514 and 515. The two inclined rims 511 are provided at an angle of 135° with respect to the perpendicular rims 507 and 508 and have a trapezoidal shape. Perpendicular rims 507 and 508 have a rectangular shape. The slant faces 514 and 515 may be provided at any desired angle with respect to the adjacent perpendicular rims 509 and 510, respectively. In the unit panel shown in FIG. 13, slant faces 514 and 515 are inclined such that both the upper and lower sides are inclined downwardly toward the edge line 506.

Figure 14:
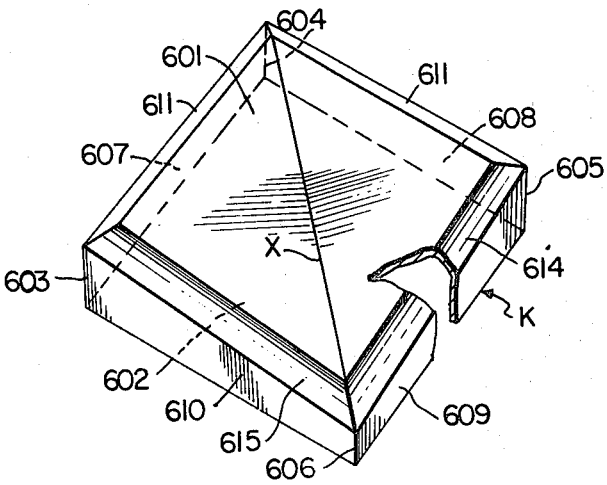

FIG. 14 shows still another unit panel K belonging to the third embodiment. The unit panel K corresponds to unit panel D which is further provided with inclined rims 611 and two slant faces 614 and 615. The inclined rims 611 must be provided at an angle of 135° with respect to the adjacent perpendicular rims 607 and 608, respectively. The slant faces 614 and 615, however, may be provided at a desired angle with respect to the adjacent perpendicular rims 609 and 610, respectively. Perpendicular rims 607 and 608 have a rectangular shape, but perpendicular rims 609, 610, inclined rims 611, and slant faces 614, 615 are all trapezoidal in shape.

Figure 15:
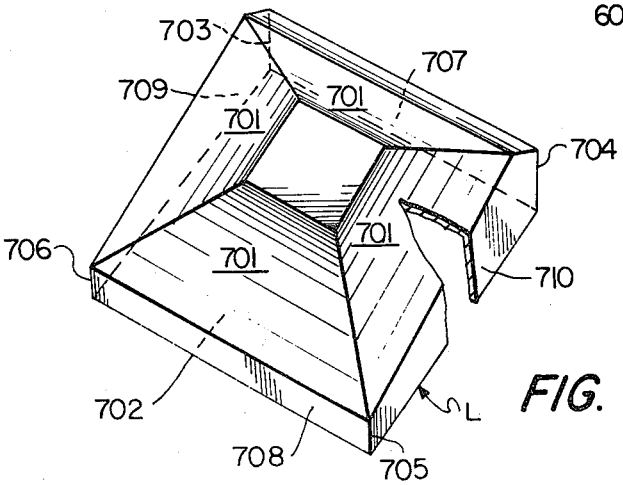
Figure 16:
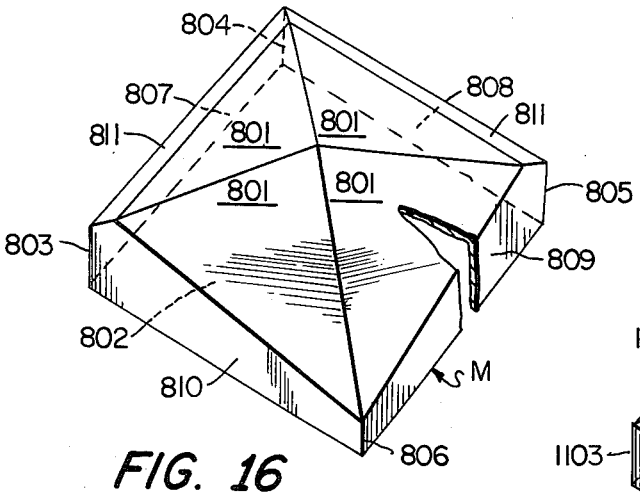

FIG. 15 shows another unit panel L according to the third embodiment. The unit panel L corresponds to unit panel C with the exception that unit panel L is provided with one inclined rim 711. The inclined rim 711 is provided between plate 701 and perpendicular rim 707 so that the inclined rim 711 is at an angle of 135° with respect to perpendicular 707.

Further unit panels within the scope of the third embodiment according to the present invention are shown in FIGS. 16, 17, 18, 19 and 20. The unit panel M shown in FIG. 16 corresponds to the unit panel F having two inclined rims 811. The inclined rims 811 are located between plate 801 and perpendicular rims 807 and 808 and make an angle of 135° with the perpendicular rims 807 and 808.

Figure 17:
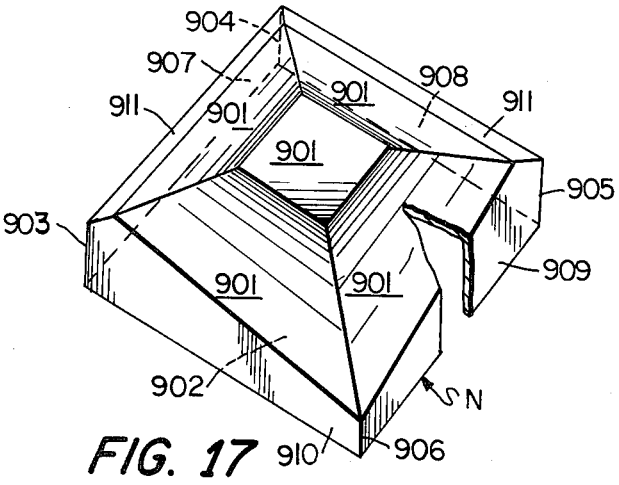

Unit panel N shown in FIG. 17 corresponds to the unit panel of FIG. 9 which is further provided with two inclined rims 911. The inclined rims 911 of unit panel N are similar to those of the unit panel M.

Each of the foregoing unit panels may be further provided with at least one slant face and the top plate (e.g., 801 and 901) may be constructed of a sandwich structure having a heat insulated material incorporated therein.

Figure 18:
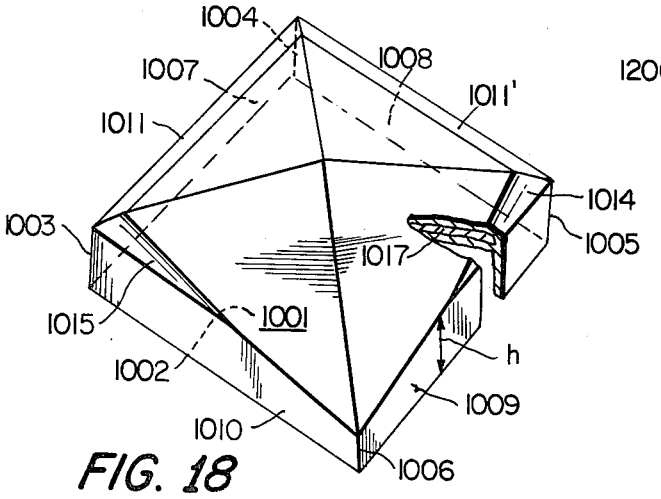

The unit panel of FIG. 18 corresponds to unit panel M further provided with two slant faces 1014 and 1015. Slant faces 1014 and 1015 are located between plate 1001 and perpendicular rims 1009 and 1010. The plate 1001 has a sandwich structure having a heat insulating material 1017 included therein.

Figure 19:
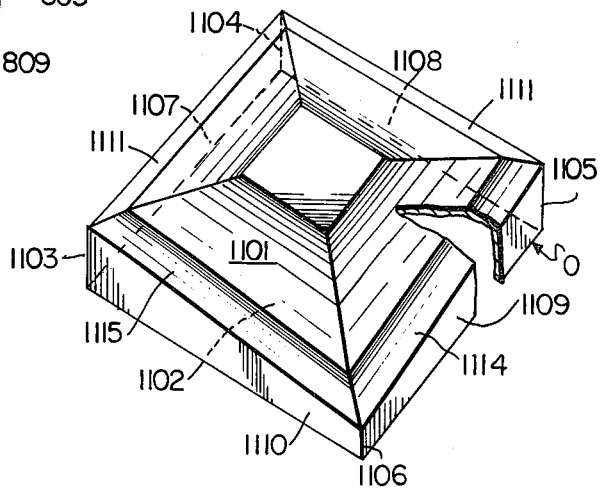
Figure 20:
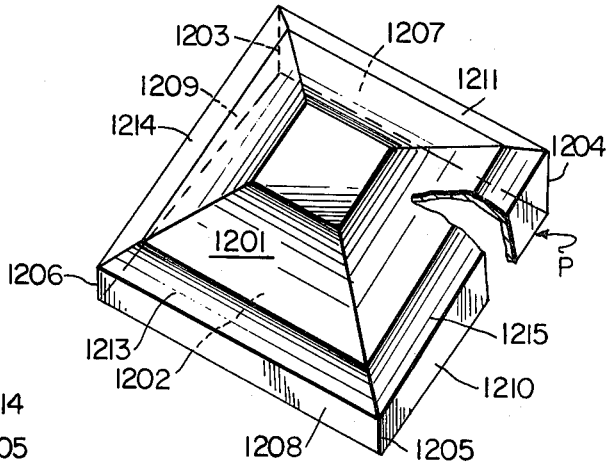

The unit panel O shown in FIG. 19 can be prepared by providing the unit panel N shown in FIG. 17 with two slant faces 1114 and 1115. Slant faces 1114 and 1115 are located between the plate 1101 and perpendicular rims 1109 and 1110, respectively. In FIG. 20 the unit panel P corresponds to the unit panel L further provided with three slant faces 1213, 1214 and 1215. Although the inclined rims 1211 must make an angle of 135° with respect to the perpendicular connecting rim 1207, each of the slant faces 1213, 1214 and 1215 can make any desired angle between 90° and 180° with the respective perpendicular connecting rims 1208, 1209 and 1210.

The fourth embodiment according to the present invention is a unit panel which comprises a projection on the top plate which should extend outwardly from the top plate in a direction opposite to the direction in which the perpendicular rims extend outwardly from the plate. The projection is preferably provided at a position in the vicinity of, i.e., contiguous to, a corner of the plate. The projection should have a side portion which forms an angle of $\theta$ of between 110° and 70° and, preferably 90° with respect to the plate and should have a flat top that is parallel to the open plane. Unit panels according to this embodiment are illustrated in FIGS. 21, 22 and 23.

Figure 21:
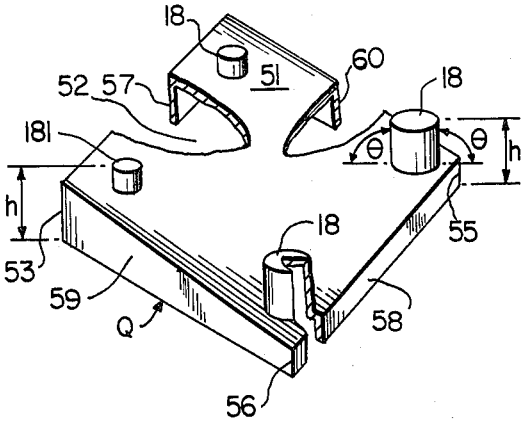

FIG. 21 shows a unit panel Q, which corresponds to unit panel A but which is further provided with four projections 18 in the vicinity of the four corners of plate 51. The projections have side portions which project from the plate 51 at an angle of $\theta=90°$. The projections 18 have a top portion 181 which is preferably parallel to the open plane 52 of the panel. All of the projections 18 should have a height h which is such that the distance from the top portion 181 to the open plane 52 is the same for each projection.

Figure 22:
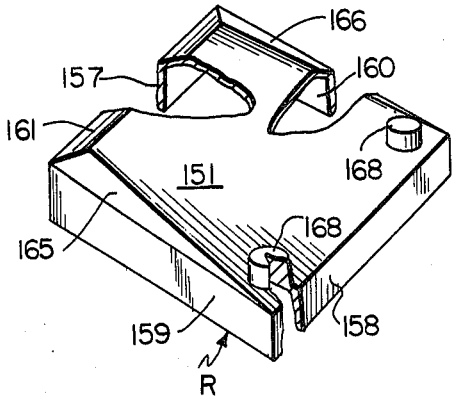

The unit panel R of FIG. 22 corresponds to the unit panel A which is further provided with an inclined connecting rim 161, two slant faces 165, 166, and two projections 168. The inclined connecting rim 161 is preferably provided at an angle of 135° with respect to the perpendicular rim 157. Each of the slant faces 165 and 166, however, may be provided at any desired angle with respect to the perpendicular rims 159 and 160, respectively. Each of the slant faces 165 and 166 has a broad width at the portion thereof close to the perpendicular rim 157; the width progressively narrowing toward the perpendicular rim 158. The two projections 168 are symmetrically provided on the plate 151 in vicinity of the perpendicular rim 158 and are identical in shape and size.

Figure 23:
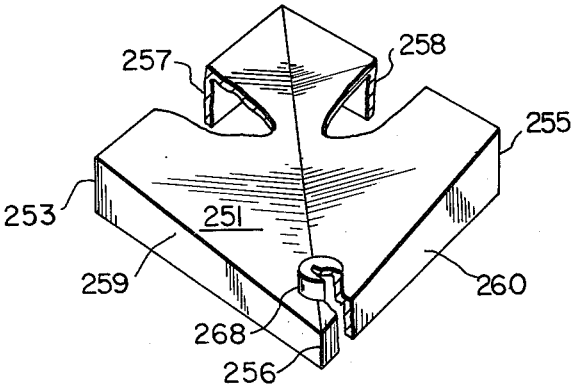

The unit panel of FIG. 23 corresponds to the unit panel D with the exception that it includes a projection 268. The unit panel of FIG. 23 has two perpendicular rims 257 and 258 which are rectangular and a plate 251 which is inclined such that the plate 251 is progressively lower in the direction of the edge line 256. The projection 268 is located in the vicinity of the edge line 256 on plate 251.

Figure 24:
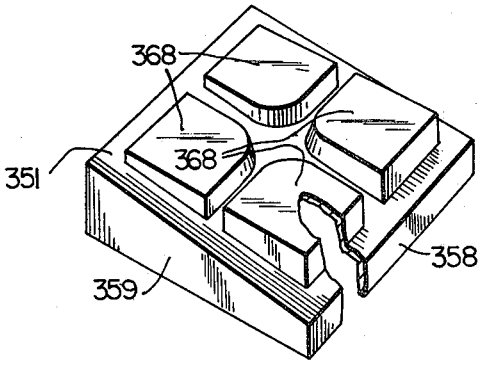

The projections 18, 168 and 268 shown in FIGS. 21, 22 and 23 have a cylindrical shape. The projections, however, may be of any desired shape such as a quadrangular prism, hexagonal prism and the like. Furthermore, the projections may be of a size such as that shown in FIG. 24 which occupies the greater portion of the top plate. The unit panel shown in FIG. 24 corresponds to the unit panel A with the exception that the unit panel is provided with the projections 368.

The fifth embodiment according to the present invention comprises a unit panel in which the top plate is provided with a recessed portion which, in turn, is provided with an aperture which serves as an outlet. Unit panels according to this embodiment are shown in FIGS. 25, 26, 27, 28 and 29.

Figure 25:
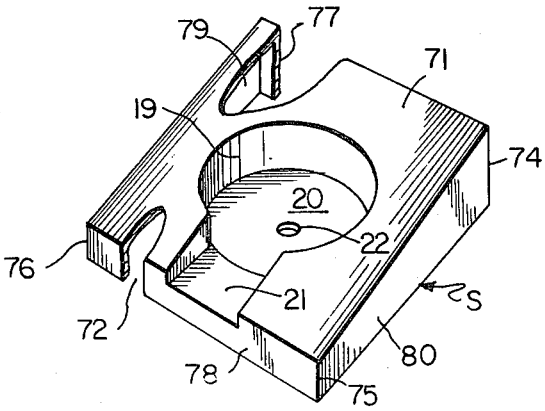

The unit panel S according to the fifth embodiment according to the present invention shown in FIG. 25 corresponds generally to the unit panel A. The unit panel S, however, has a recessed portion, a groove or a channel, and an outlet. More particularly, the unit panel has a recessed portion which can be prepared, for example by cutting a large circular hole in the center portion of plate 71, connecting a tubular member 19 having a cross section corresponding to the circular hole to the opening formed in the plate 71 as shown in FIG. 25, providing a bottom 20 in the lower portion of the tubular member 19 and perforating the bottom 20 to provide a outlet 22 therein. The channel 21 may be provided in the plate 71 in a manner similar to that for forming the recessed portion. The bottom portion of the channel 21 is located at a higher level than the bottom 20 of the recessed portion. The unit panel is used in a position to be provided with an outlet of a tank constructed employing the unit panels according to the present invention and serves as a unit panel adapted for providing an outlet for discharging a liquid from the tank.

Figure 26:
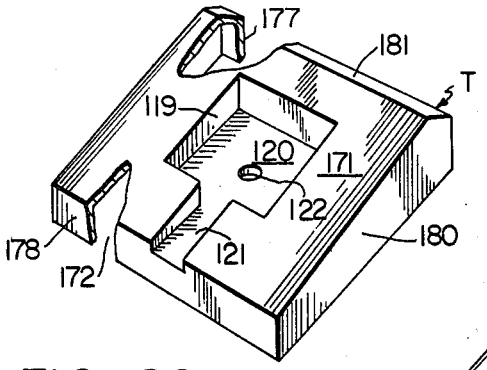

Each of FIGS. 26 to 29 shows a unit panel similar to the unit panel S shown in FIG. 25. Particularly, FIG. 26 shows a unit panel T, which corresponds to the unit panel A further provided with an inclined rim 181 between perpendicular rim 177 and plate 171, a rectangular tubular member 119 having a bottom portion, or plate, 120 which is level with the bottom of the channel 121.

Figure 27:
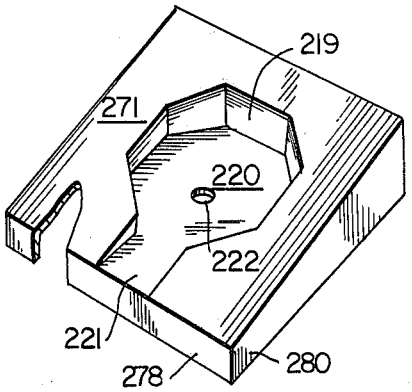

The unit panel of FIG. 27 has a tubular member, or pipe, 219 having an octagonal cross section. The bottom 220 of the tubular member is continuous with that of channel 221 which, in turn, is connected with the upper ends of the perpendicular rim 278.

Figure 28:
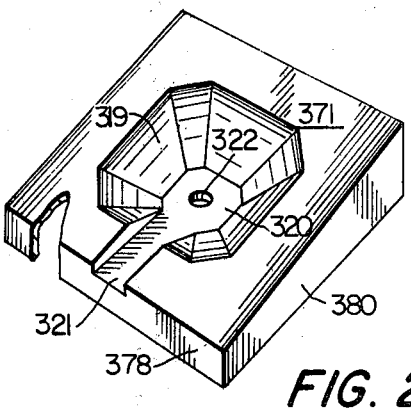

FIG. 28 shows a further unit panel in which the tubular member, or pipe, 319 defining the recessed portion has an octagonal cross section which becomes progressively smaller in the direction of the open plane.

Figure 29:
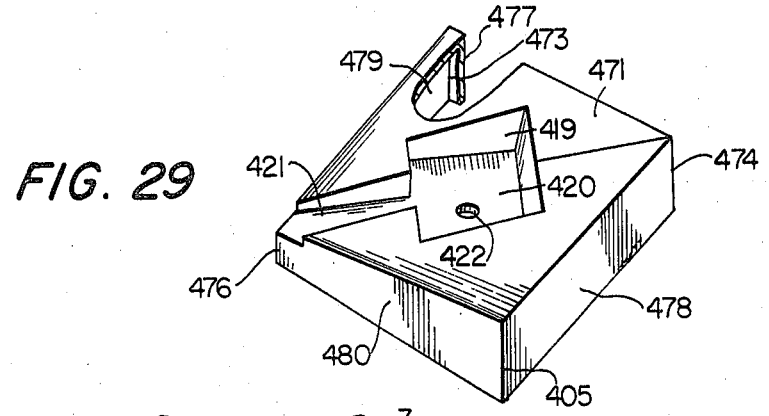

The unit panel shown in FIG. 29 corresponds to the unit panel D but which is further provided with a recessed portion and channel. Particularly, the unit panel has two adjacent perpendicular rims 477 and 478 which are rectangular in shape with two remaining adjacent perpendicular rims 479 and 480 having a trapezoidal shape. The three edge lines 474, 475 and 477 formed by the adjacent perpendicular rims 477 and 478 are longer than the remaining edge line 476 formed between perpendicular rims 479 and 480. Plate 471 is folded along a diagonal line connecting the edge line 474 with the edge line 476 to form a concave surface. A recessed portion is formed in the plate 471 at the center thereof together with a channel 421 which is formed between the recessed portion and a corner of the unit panel contiguous to edge line 476.

The unit panels described above may be used in the manner described hereinbelow.

Figure 1:
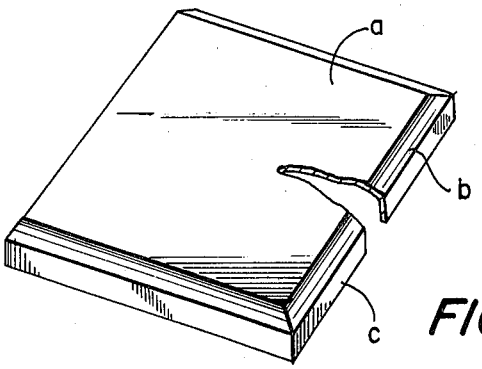
FIG. 1 is a perspective view of a unit panel of the prior art.
Figure 30:
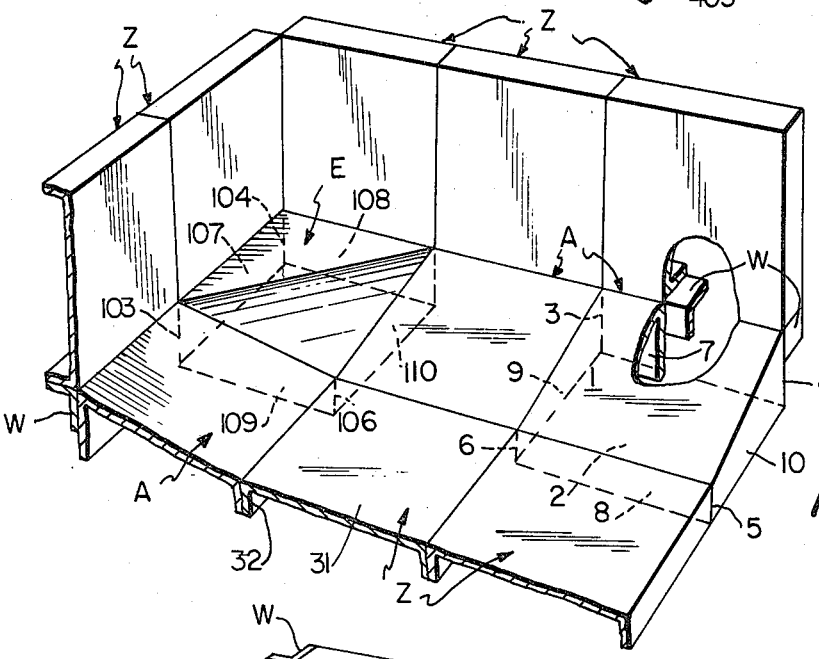

Referring to FIG. 30, a prospective view of a storage tank is shown, partly cut away, which is prepared by assembling the unit panels A shown in FIG. 2, the unit panel E shown in FIG. 7 and the unit panels of prior art (shown in FIG. 1) and identified in FIG. 30 as unit panel Z. The unit panels A and E are used for forming a portion of the bottom of the tank adjacent the sidewall thereof whereas the prior art unit panels Z are used for forming the interior portion of the bottom and the sidewalls of the tank.

The prior art unit panel Z employed in constructing the tank illustrated in FIG. 30 comprises a rectangular plate 31 and four perpendicular rims 32 standing at the four sides of plate 31 and being perpendicular with respect thereto. Each of the perpendicular rims are equal to each other in height and are also equal to the length of the smaller edge lines 5 and 6 of unit panel A.

The relationship between the geometry of the unit panels A and E are such that the trapezoidal perpendicular connecting rims 9 and 10 of unit panel A are identical in shape and size to the trapezoidal perpendicular rims of the unit panel E. Thus, when these rims are placed in contact with each other, the panels can be arranged to form a rectangular bottom without forming any gaps between the unit panels. The unit panel E is always located at a corner of the bottom so that the shorter edge line 106 is directed toward the interior portion of the bottom.

When the unit panels E are located at the corners and the unit panels A are located between the unit panels E to form a tank bottom, vacancies remaining in the tank bottom may be filled by the unit panels Z. The unit panels E, A and Z may be connected together by bolting the perpendicular rims thereof which are in contact with each other to form a tank bottom not having any voids therein. Where tight connections are required between the unit panels, packing materials may be placed between the connecting rims prior to the bolting of the rims. Unit panels E, A and Z together form an inclined tank bottom which is progressively recessed, or inclined downwardly, toward the center thereof. Such a tank bottom has the advantages that liquid will gather in the recessed center and can be completely discharged from the tank without difficulty if a vent is provided at the center thereof.

A tank may be assembled from the inclined bottom by the use of angle bars W shown in FIG. 30 which are connected to the outside of the inclined bottom by means of the perpendicular rims 7 of the unit panels A and perpendicular rims 107 and 108 of unit panels E. The unit panels Z employed for the sidewalls of the tank are also connected to the angle bar W by suitable means.

Figure 31:
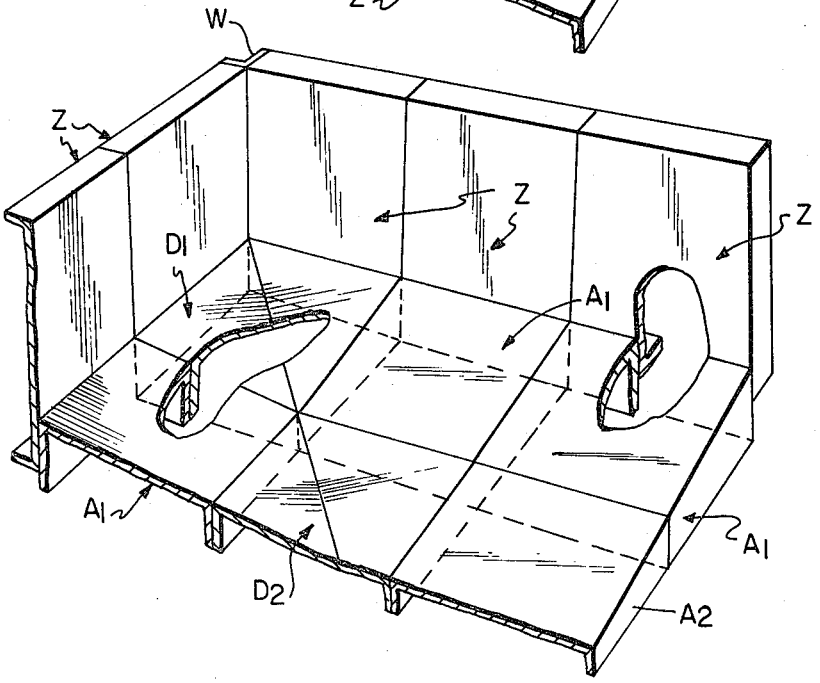

FIG. 31 is prospective view of another tank, partly cut away, which is constructed from unit panels A (FIG. 2) and unit panels D (FIG. 6) which form the tank bottom and the prior art unit panels Z which form the sidewalls. Particularly, two different unit panels $A_1$ and $A_2$, which differ in height alone, are employed as the unit panel A, and two unit panels $D_1$ and $D_2$, which also differ in height alone, are employed as the unit panel D. The unit panels $A_1$, $A_2$ and $D_2$ are assembled to form an inclined bottom, in which the unit panels $A_1$ and $D_1$ are located along the portion of the bottom adjacent the sidewalls, while the unit panels $A_2$ and $D_2$ are located in the interior portion of the bottom. With respect to the unit panels $A_1$ and $A_2$, the shorter rectangular rim of unit panel $A_1$ is identical in shape and dimensions to the taller rectangular rim of unit panel $A_2$. Furthermore, the inclination, or slope, of unit panels $A_1$ and $A_2$ with respect to the bottom edge of the trapezoidal rims thereof are identical. With respect to the unit panels $A_1$ and $D_2$, the trapezoidal rim and rectangular rim of unit panel $A_1$ are identical in shape and dimension to trapezoidal rim and the taller rectangular rim of the unit panel $D_1$. The shorter rectangular rim of unit panel $A_1$ is identical with respect to shape and dimensions to the rectangular rim of unit panel $D_2$. Additionally, the trapezoidal rim of unit panel $D_2$ is identical in shape and size to the trapezoidal rim of unit panel $A_2$. The unit panels are arranged such that the unit panels $D_1$ with the rectangular rim thereof facing toward the outside form the corners of a tank bottom, the unit panel $A_1$ being placed between the unit panels $D_1$ with the taller rectangular rim of the unit panels $A_1$ facing toward the outside of the tank thereby forming a rectangular frame. Subsequently, the unit panels $D_2$ and $A_2$ are placed within the rectangular frame and the unit panels are bolted together to obtain an inclined bottom as shown in FIG. 31. The tank bottom shown in FIG. 31 is inclined downwardly over at least two unit panels from the edge of the tank toward the center.

In the tank construction shown in FIG. 31, prior art unit panels Z are mounted on the above-described inclined bottom to form the tank. In mounting the prior art unit panel Z on the tank bottom, plate 31 of the unit panel Z is connected directly and connected to the outside connecting rims of the unit panels $A_1$ and $D_1$ without using the angle bar W. The unit panels Z, however, are connected to each other by means of the angle bar W to form the sidewalls of the tank.

Figure 32:
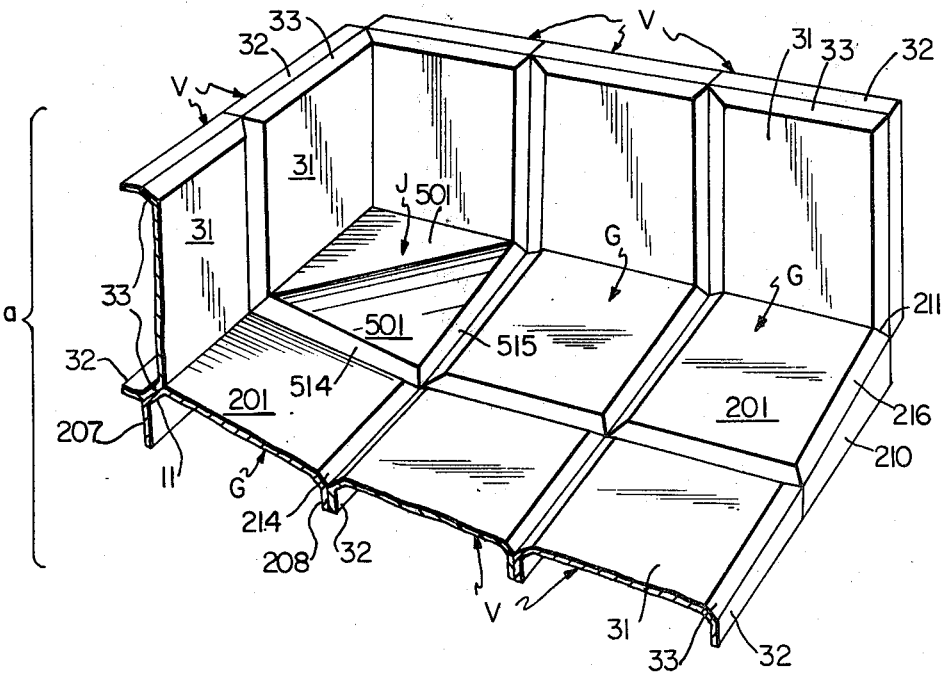
FIGS. 30 to 38 show inclined bottoms of a tank constructed by connecting unit panels according to the present invention. Portions of some of the bottoms are cut away for clarity.

FIG. 32 shows a tank according to the present invention having an inclined bottom which is shown partly cut away and which is formed by arranging unit panels G (shown in FIG. 10), unit panels J (shown in FIG. 13), and prior art unit panels V. As to the relationship between the unit panels G and J, the taller perpendicular rim 207 of unit panel G is identical in shape and size to perpendicular rims 507 and 508, having a rectangular shape, of unit panel J. Perpendicular rims 209 and 210 of unit panel G having a trapezoidal shape are identical with respect to shape and dimension to perpendicular rims 509 and 510 of unit panel J. The prior art unit panel V comprises a rectangular plate with connecting rims which consist of inclined rims and perpendicular rims; the inclined rims being provided at the periphery of plate 31 so as to extend at an angle of 135° with respect to the plane of the plate 31 and the perpendicular rims being provided at the outer edge of each inclined rim and having an angle of 135° with respect to the plane of the inclined rim. Accordingly, the perpendicular rims have an angle of 90° with respect to the plane of the plate 31.

Figure 33:
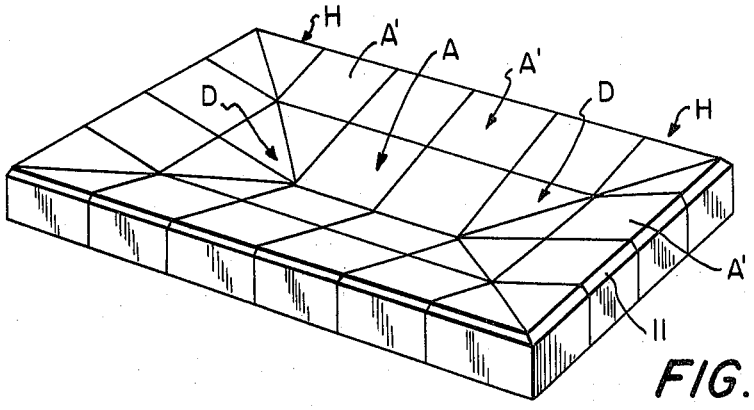

FIG. 33 shows an inclined bottom which can be prepared employing the unit panels according to the present invention and which is constructed of unit panel A as shown in FIG. 2, modified unit panels A', unit panels H shown in FIG. 11, and unit panels D shown in FIG. 6. The bottom shown in FIG. 33 which, for example, could be the bottom of a storage tank, is progressively, or continuously recessed toward the center thereof. Particularly, unit panels H are located at the corners of the bottom construction with the unit panels A' being placed between the unit panels H in a single row to form an outline of the bottom. The unit panels D are then located at corners inside the outline or contour, the unit panels A are likewise placed inside the unit panels A', and the bottom is thus formed. The unit panel A' corresponds to the unit panel A provided, however, with an inclined rim 11' between the top plate and the taller perpendicular rectangular rim thereof. Unit panels A and A', however, differ in height such that the taller perpendicular rim of unit panel A is identical in shape and size to the shorter perpendicular rim of unit panel A'. Both unit panels A and A' are identical inclined with respect to the respective open planes thereof. Rectangular perpendicular rims 107 and 108 of unit panel D are identical in shape and size to the rectangular perpendicular rim 8, having the smaller height, of unit panel A. Trapezoidal perpendicular rims 109 and 110 of unit panel D are identical in shape and size to trapezoidal perpendicular rims 9 and 10 of unit panel A. When the unit panels H, A', D and A are assembled in the above-described manner, the resulting bottom is gradually recessed with the same angle of inclination from the periphery of the bottom to the center thereof. When a small amount of liquid is placed on the bottom, the liquid is gathered at the center and can be completely discharged from the bottom. Incidentally, it is to be noted that inclined rims of the unit panels H and A' are adapted for mounting unit panels which form sidewalls of the tank.

Figure 34:
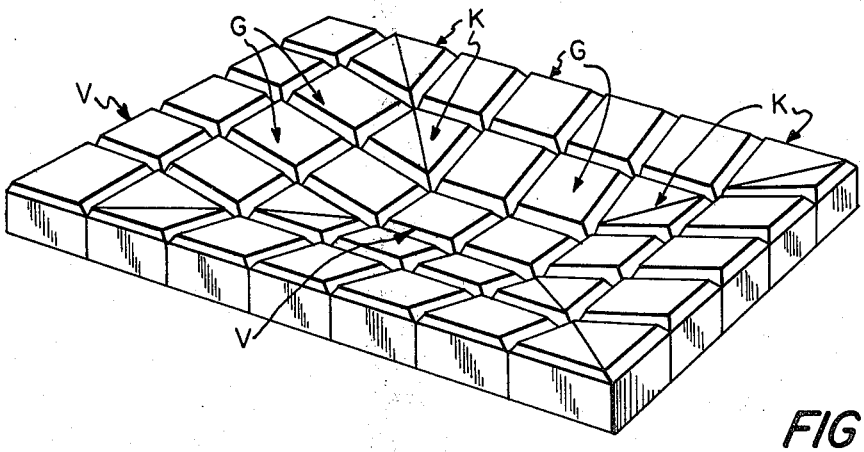

FIG. 34 shows another inclined bottom which is constructed of unit panels G shown in FIG. 10, unit panels K shown in FIG. 14 and the prior art unit panels V. The bottom shown in FIG. 34 is constructed by employing two different types of the unit panel K, which differ only in the height thereof, instead of the unit panels H and D of FIG. 33 and employing unit panels G instead of unit panels A and A' and further using the prior art panels V for forming an outer portion of the periphery and the center portion of the bottom. According to this embodiment, channels are formed between adjacent unit panels and the channels and unit panels slope progressively toward the center of the bottom. Thus, when liquid is placed on the bottom the liquid flows along the channels and gathers at the center of the bottom and enables the bottom to be well-drained.

Figure 35:
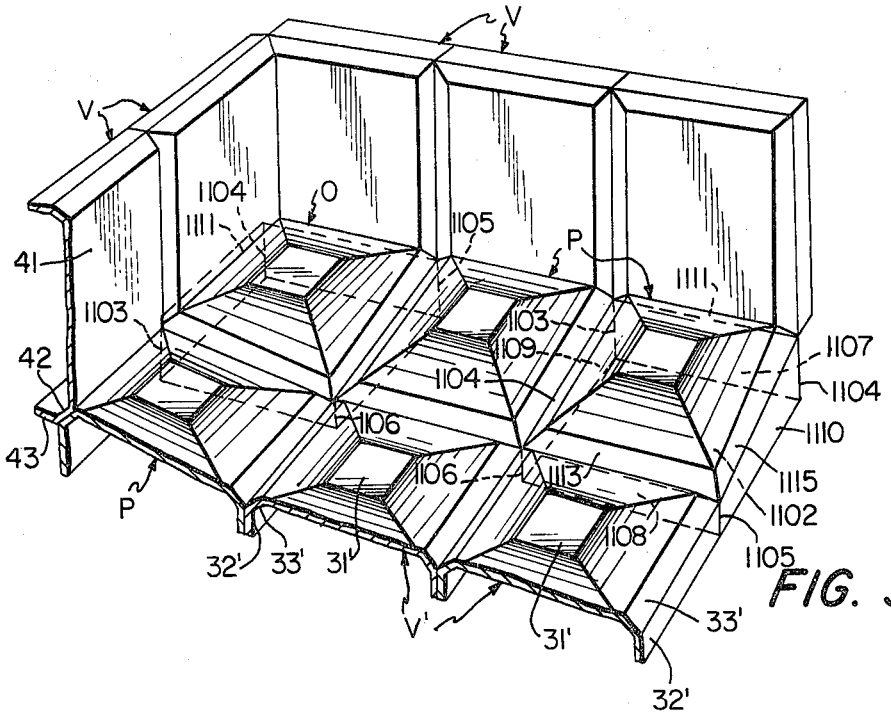
Figure 36:
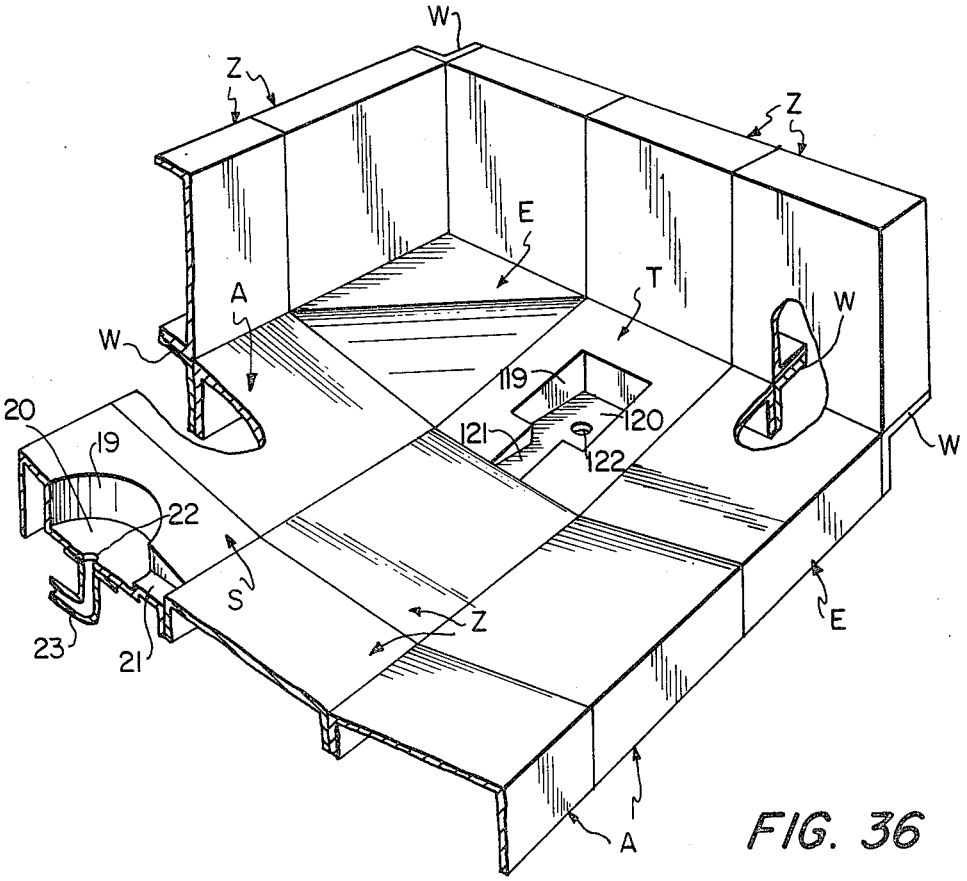

FIG. 35 shows another portion of a tank bottom which is constructed of unit panels O shown in FIG. 19, unit panels P shown in FIG. 20 and prior art unit panels V'. Particularly, unit panels O are located at the corners of the bottom, unit panels P are placed between unit panels O along rows, and the prior art unit panels V' are arranged in the remaining spaces to form the bottom. No unit panels V' are similar to unit panels V referred to in the description of the bottom shown in FIG. 32 but differ therefrom in that the plate 31' is raised in the form of truncated quadrangular pyramid. The bottom shown in FIG. 35 is provided with inclined rims 1111 extending around its periphery. Prior art units panels V are further mounted on the inclined rims 1111 to form sidewalls on the bottom thereby forming a tank. In connecting the unit panels, packing materials may be placed between the connecting rims which are to be connected together prior to bolting the rims so as to ensure against leakage. which is constructed of unit panels E shown in FIG. 7, unit panels A shown in FIG. 2, unit panels Z shown in FIG. 30, unit panels S shown in FIG. 25 and unit panels T shown in FIG. 26. More particularly, the unit panels E are located at the corners of the bottom to be formed, unit panels A aligned between the unit panels E to form a frame of the bottom, the unit panels Z are arranged within the frame, some of the unit panels A are replaced by the unit panels S and T, which are located such that the channels 21 and 121 of the respective unit panels are in the vicinity of the center and extend toward the center of the bottom, and these unit panels are bolted together to form the bottom. Packing materials may be placed between the connecting rims of the unit panels to ensure tight connection between the unit panels. The bottom is further provided with sidewalls by mounting the prior art unit panels Z on the periphery of the bottom by means of angle bar W. Outlets 22 and 122 of the unit panels S and T, respectively, are provided with elbows 23. As the amount of liquid in the tank is decreased, the liquid gathers in the center portion of the bottom and, if further decreased, gathers in the recessed portions 20 and 120 by means of the channels 21 and 121. The liquid, therefore, can be completely discharged from the bottom through the pipes 23 and tank is convenient for carrying out a lavage of the inside of the tank.

Figure 37:
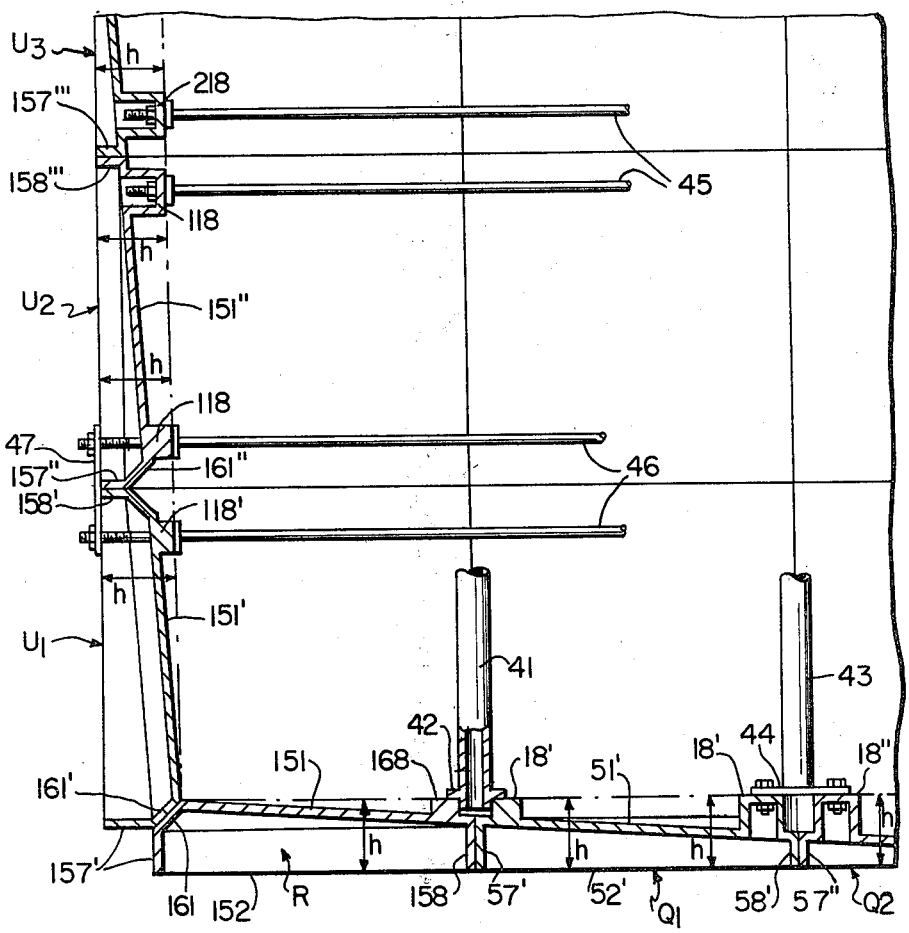

FIG. 37 shows a portion of a vertical section of a tank according to the present invention which includes an inclined bottom comprising the unit panels Q and R shown in FIGS. 21 and 22, respectively, and inclined sidewalls comprising unit panels $U_1$ to $U_3$ which are similar to the unit panels Q and R. Specifically, the unit panels R are arranged at the periphery of a tank bottom to be formed, with the unit panels Q being arranged in the interior of the tank bottom. When the unit panels R and Q are arranged from the periphery to the interior of a bottom, the height of the panels should be varied so as to form a flat slope which decreases in height from the periphery toward the center of the bottom. In other words, the upper surface of the unit panel R located as a periphery of the bottom should preferably form an extension of the upper surface of the adjacent unit panel $Q_1$. To this end, the perpendicular rim 158 of the unit panel R should preferably have a shape and size identical to that of the perpendicular rim 57' of unit panel $Q_1$. Similarly, perpendicular rim 58' of unit panel $Q_1$ should have a shape and size identical to that of perpendicular rim 57'' of unit panel $Q_2$.

In the unit panels shown in FIG. 37, all of the various projections 18, 118, 218, etc., have the same height relative to the open plane 2 of the respective unit panels. Additionally, the forward ends of the projections are all parallel to the open plane of the respective panels. Thus, when two unit panels R and two unit panels $Q_1$ are connected together, a projection 168 of each of the panels R and a projection 18' of each of the unit panel $Q_1$ form a type of enclosure at the center of the section formed by the four panels. The tops of the four projections are on the same horizontal plane. Thus, a support 41 can be inserted into the enclosure such that the brim, or flange, 42 of the support contacts the forward end of each of the projections. The support can stand upright and the length of the support 42 from the brim 42 to the upper ends of the support is the same for every support. Thus, if a cover is placed on the upper ends of the supports 41, the cover can be maintained in a horizontal position. The projections provided on the unit panels serve to hold the support upright in the tank and to maintain the supports at a uniform level.

FIG. 37 shows various modes of inserting a support end into an enclosure formed by the projections provided on the unit panels. For example, support 41 is inserted in the enclosure such that brim 42 is contacted with and supported by the tops, or forward ends, of the projections as described above. Support 43 has at its end a flange 44, which is contacted with and bolted to the forward end of the projections 18' and 18''.

FIG. 37 also illustrates the use of the unit panels according to the present invention in constructing the sidewalls of a tank. Unit panel $U_1$ which is located at the lower end of the sidewall shown in FIG. 37, has a structure such that the projections 118' are provided at symmetrical positions with respect to the edge lines at the shorter end of the unit panel. Unit panel $U_2$ which is located above the unit panel $U_1$, has a structure wherein the projections are provided at symmetrical positions corresponding to positions on the plate 151 adjacent the inclined rim 161 of the unit panel shown in FIG. 22. Unit panel $U_3$ which is located above the unit panel $U_2$, is the unit panel Q shown in FIG. 21. In the unit panels $U_1$, $U_2$ and $U_3$, the forward ends of the projections provided thereon are all at the same level h with respect to the open plane 2 of the respective unit panels. Two of the perpendicular connecting rims in contact with each other, for example, the perpendicular rims 157'' and 158' of the unit panels $U_2$ and $U_1$, respectively, are identical in shape and size.

When the unit panels $U_1$, $U_2$ and $U_3$ are assembled to form sidewalls, the wall surface formed by the top plate of each of the panels is inclined so as to be progressively broadened toward the top of the sidewall. In order to stabilize the sidewalls relative to the bottom, in general, two opposing sidewalls are supported by bars bridged between them. Because the projections are at the same level with respect to the open plane, the bars provided between the projections in opposing sidewalls may have the same length even though the sidewalls are inclined. Thus, bars of identical length can be used for supporting opposing unit panels as shown in FIG. 37, in which stays 45 and 46 having two brims or flanges secured at a given distance are used for supporting the opposing sidewalls. This advantage is made possible by the use of unit panels having projections provided thereon as described above for constructing the sidewalls.

It is to be noted that in FIG. 37, stays 45 and 46 are varied in structure to illustrate various modes of construction. With respect to stays 45, the projections 118 and 218 are hollow and have thin walls such that an end of the stays 45 is secured to the forward end of the hollow projections from the inside by the use of bolts. With respect to stays 46, the stay extends through the projection (118 and 118') and through a plate 47 which is in contact with the forward ends of perpendicular rims 157'' and 158', the end of the stay 46 being secured to the plate 47 through the use of bolts. Although the stays may have embodiments such as those described above, advantageously identical stays are employed to decrease the number of parts required for assembling the unit panels.

Figure 38:
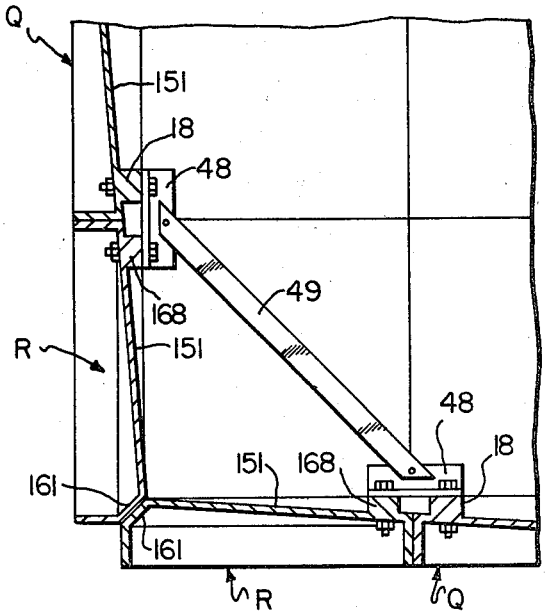

Projections provided on the unit panels according to the present invention can also be used for securing the sidewalls of a prefabricated container or tank constructed therefrom to the bottom. FIG. 38 illustrates such a construction. In FIG. 38, unit panel R (shown in FIG. 22) is located at the periphery of an inclined bottom which is to be constructed with unit panel Q (shown in FIG. 21) located in the inner portion of the bottom and connected to the unit panel R to form the inclined bottom. A second unit panel R is mounted on the periphery of the bottom and another unit panel Q is mounted on the second unit panel R to form an inclined sidewall. To connect the second unit panel R to the periphery of the inclined bottom, inclined rims 161 in each of the unit panels R are placed in contact with each other and bolted together. Angle bar 48 is secured to the projections 18 and 168 of each of the tank bottom and sidewall and a metal bar 49 is bridged therebetween. In this manner, the bottom and sidewall are securely connected together and the tank constructed therefrom is deformed to a lesser extent when the tank is filled with water.

The unit panels according to the present invention are conveniently employed for assembling an inclined bottom. Particularly, the inclined bottom can be prepared without difficulty by arranging and connecting a plurality of unit panels of the same kind. When the unit panels are to be connected together, a packing material may be placed between the connecting rims thereof to ensure against leakage. When a desired number of the unit panels are thus connected together, an inclined bottom can be obtained to have the desired extension without difficulty. A unit panel according to the present invention having a recessed portion can be provided at portions of the inclined bottom to enable liquid to be completely discharged from the tank and is convenient for carrying out a lavage of the inside of the tank. Furthermore, the unit panels can be used for constructing sidewalls of a tank. Projections may be provided on the unit panels to stabilize the walls of the tank and to provide means for supporting a cover of the tank. Further advantages of the unit panels according to the present invention will be understood by those skilled in the art from a reading of the foregoing description.

What is claimed is:

1. A storage tank comprising:

an inclined bottom, the inclined bottom comprising a plurality of unit panels and packing materials;

each unit panel comprising a rectangular plate and four connecting rims, each of said connecting rims being formed at each of the four sides of the rectangular plate and extending in the same direction and only in one direction with respect to the rectangular plate to form a shallow lid; two of the connecting rims having rectangular shapes and the other two connecting rims having trapezoidal shapes; the forward ends of the connecting rims defining a flat plane and each of the connecting rims being perpendicular with respect to the flat plane and the rectangular plate being inclined with respect to the flat plane;

the packing materials being interposed between adjacent connecting rims of the unit panels; and the unit panels being connected to form a rectangular bottom in which all rectangular plates of the unit panels slope progressively downwardly from the periphery of the bottom toward the center thereof.

2. A storage tank as defined in claim 1, wherein a portion of the plurality of unit panels have projecting means on the rectangular plate thereof, a supporting means is supported by said projecting means, and a cover is supported by said supporting means.

3. A storage tank as defined in claim 1, wherein a unit panel having a recessed portion on the rectangular plate thereof is provided in the lowest position of the bottom, and an outlet which cooperates with said recessed portion for discharging liquid from the tank.

4. A storage tank comprising inclined sidewalls and an inclined bottom, said sidewalls and bottom each comprising a plurality of unit panels;

each unit panel comprising a rectangular plate and four connecting rims, each of said connecting rims being formed at each of the four sides of the rectangular plate and extending in the same direction and only in one direction with respect to the rectangular plate to form a shallow lid; two of the connecting rims having rectangular shapes and the other two connecting rims having trapezoidal shapes; the forward ends of the connecting rims defining a flat plane and each of the connecting rims being perpendicular with respect to the flat plane and the rectangular plate being inclined with respect to the flat plane.

5. A storage tank as defined in claim 1, wherein opposing sidewalls comprise unit panels having projecting means provided on the rectangular plate thereof and at least one stay bridging projecting means of the opposing sidewalls to secure the sidewalls firmly to each other.

6. A storage tank as defined in claim 1, wherein the unit panels of the sidewall and bottom are provided with projecting means on the rectangular plates thereof and wherein at least one stay is connected to projecting means of adjacent panels of the sidewall and bottom, respectively, to secure the sidewall to the bottom.

* * * * *